United States Patent [19]

Cartabbia

[11] 4,004,720

[45] Jan. 25, 1977

[54] IRONING MACHINE FOR IRONING COLLARS AND LAPELS OF CLOTHING GOODS

[76] Inventor: Giovanni Cartabbia, Via Predore 10, 24067 Sarnico, Italy

[22] Filed: Dec. 19, 1975

[21] Appl. No.: 642,530

[30] Foreign Application Priority Data

Dec. 23, 1974 Italy ..... 30965/74

[52] U.S. Cl. ..... 223/57

[51] Int. Cl.² ..... D06C 15/00

[58] Field of Search ..... 223/51, 52, 52.1, 57, 223/70; 38/21, 23

[56] References Cited

UNITED STATES PATENTS

| | | | |
|---|---|---|---|
| 3,749,292 | 7/1973 | Engelbart | 223/57 |
| 3,895,749 | 7/1975 | Cartabbia | 223/57 |
| 3,902,261 | 9/1975 | Cartabbia | 38/21 |

*Primary Examiner*—G. V. Larkin

*Attorney, Agent, or Firm*—William Anthony Drucker

[57] ABSTRACT

An improved machine for ironing of the collars and lapels of articles of clothing includes a dummy secured on a shaft rotatable about a vertical axis, a first mould disposed laterally of the dummy and movable orthogonally to the rear portion of the dummy and having a shaped configuration to coincide with the lapels of the article of clothing, and a second mould disposed vertically above the dummy and movable in a direction coinciding with the axis of the dummy and having a shaped configuration to coincide with the upper portion of the dummy for ironing of the rear portion and lateral parts of the collar.

7 Claims, 5 Drawing Figures

IRONING MACHINE FOR IRONING COLLARS AND LAPELS OF CLOTHING GOODS

Figure 1:
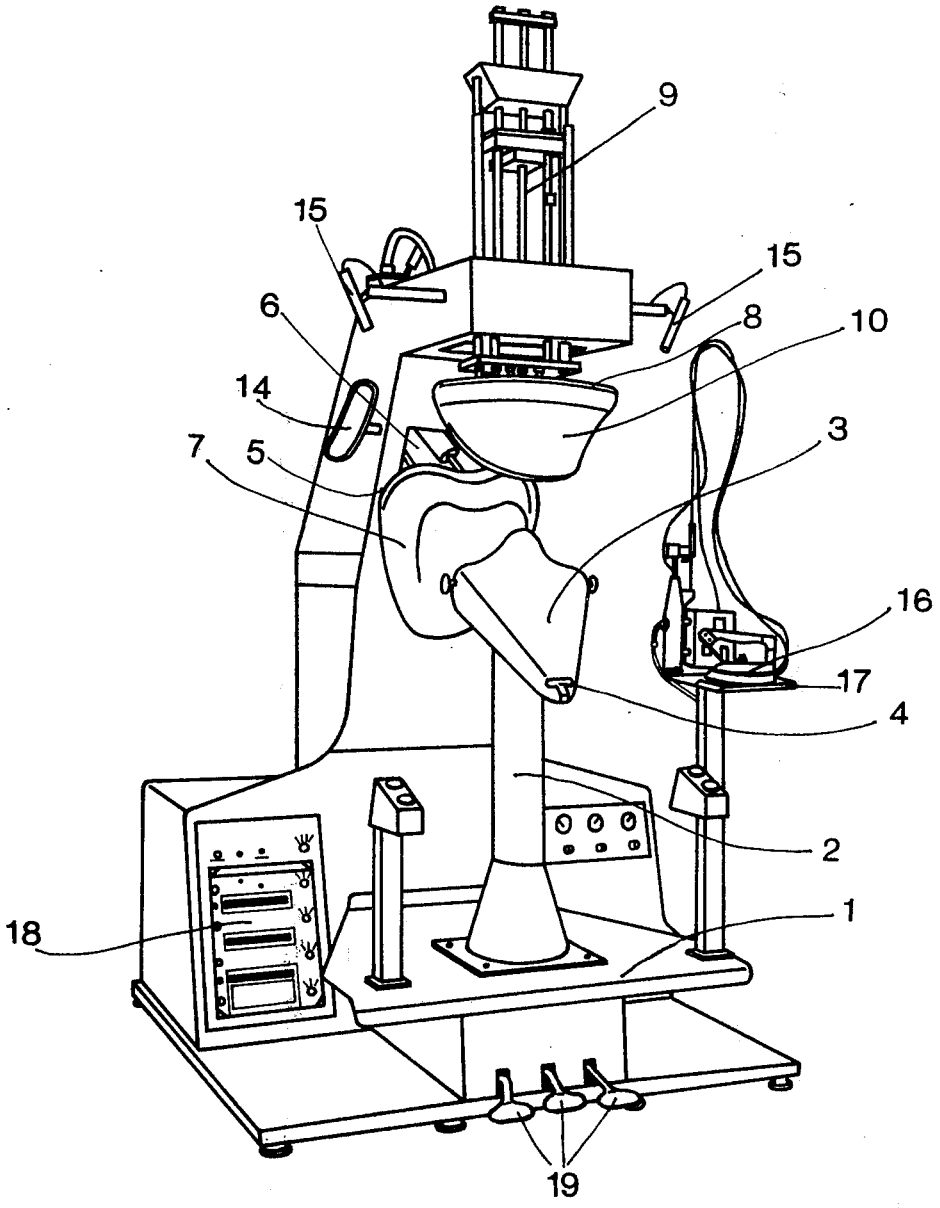
Figure 3:
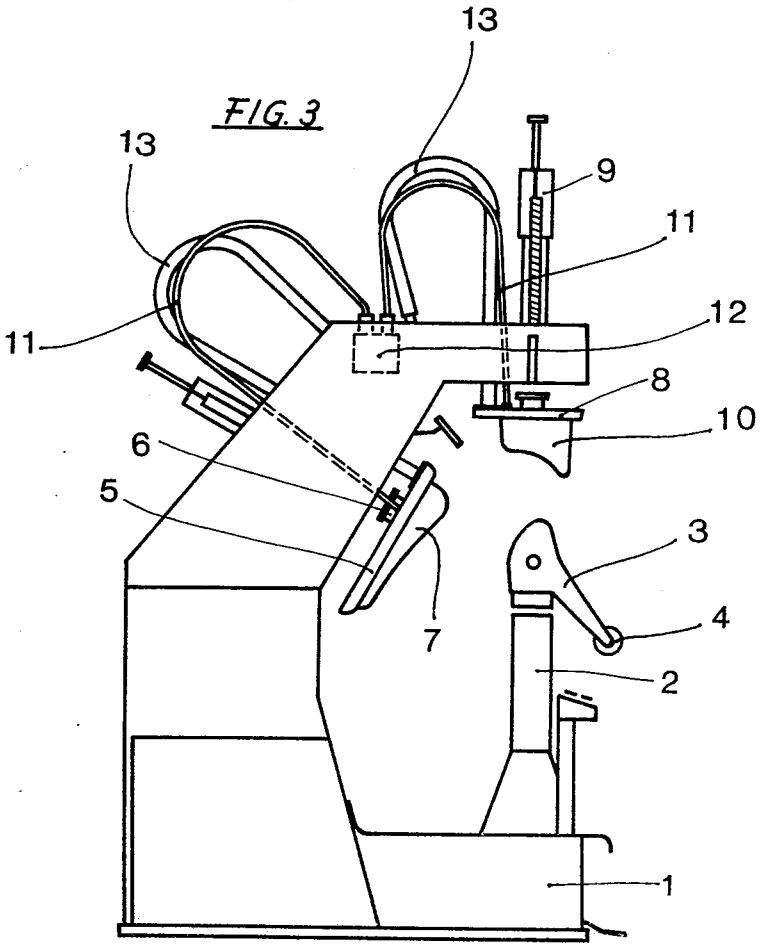
Figure 2:
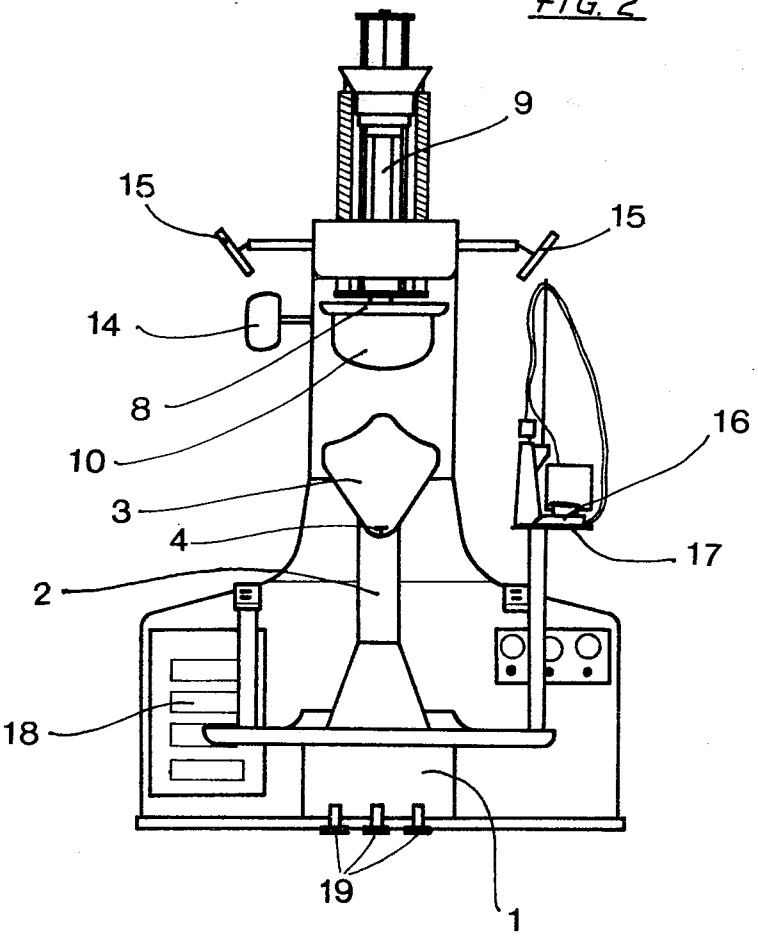
Figure 5:
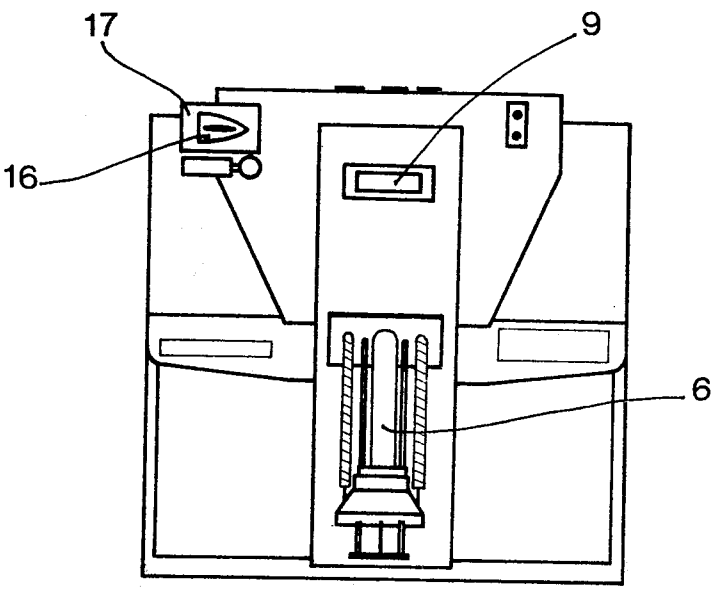
Figure 4:
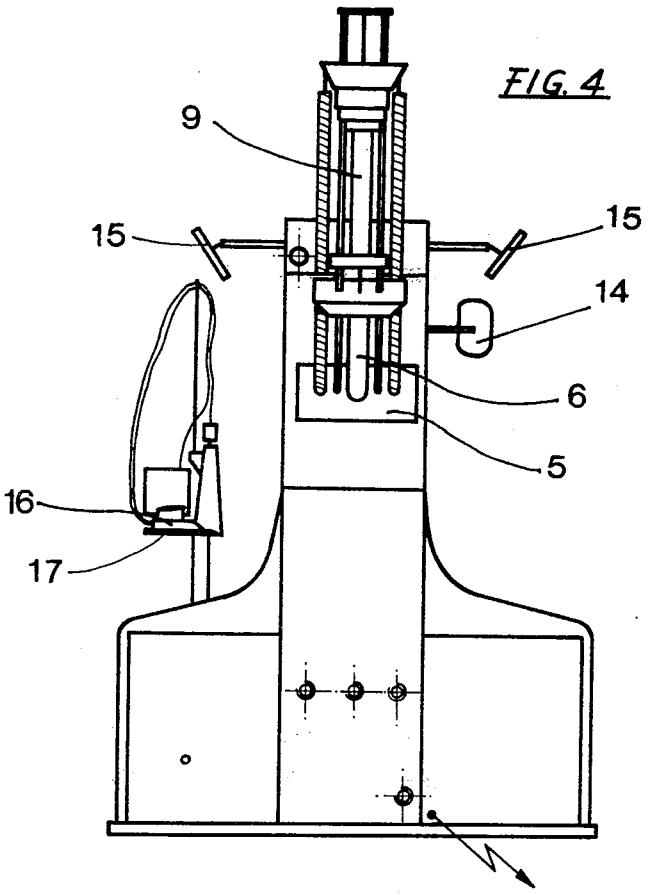

This invention relates to an improved ironing machine for the automatic ironing of the collars and lapels of articles of clothing, such as jackets, overcoats and the like, and more specifically to an improved ironing machine for ironing the collars and lapels of articles of clothing, such as jackets, overcoats and the like.

As is well known in the clothing industry, considerable difficulties are experienced in connection with the ironing of jackets due to the complex shape of the jackets themselves.

Such difficulties mostly occur when it comes to ironing the collar and the lapels of the article. The operation of ironing of the collar and lapels cannot be carried out by means of ordinary ironing machines because of the particular curvature of the portion of material constituting the collar itself.

Consequently, the operation of ironing such parts of a jacket or other similar article of clothing is carried out at present by means of a plurality of ironing machines. This obviously involves a considerable time loss and more labour, which adversely affects the cost of the manufactured article.

It is, therefore, the object of this invention to provide an ironing machine which does not have the aforesaid operating difficulties. More particularly, it is an object of this invention to provide an ironing machine permitting to carry out automatically the ironing operation in subsequent phases of the collar and lapels of a jacket or other similar article of clothing.

In its essential features, the improved ironing machine of this invention serving to iron collars and lapels, consists substantially of the upper portion of a dummy, suitably shaped at its front portion.

On the rear portion of the collar of the dummy there bears, in a direction normal to the part itself, a hollow mould covered and adapted to fit the surface of the collar itself.

On the front portion of the dummy there may bear a second shaped mould, adapted to carry out the ironing of both lapels. The said second shaped mould is articulated at its upper end and connected to a member adjustable relative to a stationary part.

With such a construction, it is possible to vary within predetermined limits the inclination of the mould relative to the front upper surface of the dummy, and consequently to define, depending on requirements, the position of the breaking point of the jacket lapels. Furthermore, the ironing action is exerted in a direction orthogonal to the plane of the material so as not to provoke any tangential traction.

In order to ensure an adequate rationalization of the operating cycle of the improved ironing machine of this invention, it is preferred that both ironing moulds be respectively disposed on the vertical line of the dummy and at the rear of it. In another embodiment of the invention, the said ironing platens are arranged at the sides of the dummy.

The ironing machine is provided with a mirror which permits an operator to observe the rear portion of the article to be ironed, and two or more optical projectors. The latter project beams of light onto the dummy, so as to facilitate the fitting over it of the article of clothing.

The arrangement in vertical direction of one of the said ironing moulds ensures that the mould may be used by means of a hand control in order to adjust, by pre-steaming and pre-pressing, the position of the article on the dummy. Such pre-treatment enables a better adaption of the material to the surface structure of the dummy itself, which is frontally disposed to the operator.

The aforesaid presser mould may travel in a vertical direction, and effects in particular the ironing of the rear portion and the two side portions of the collar.

Subsequently, the dummy rotates through 180°, in front of the rear mould, which carries out the ironing of the article.

These and further characteristic features of a functional and constructional nature of the improved ironing machine of this invention will better be understood from the following detailed description taken in conjunction with the accompanying drawings, in which:

FIG. 1 shows the improved ironing machine of this invention in a perspective front view, and FIGS. 2, 3, 4 and 5 represent the same ironing machine as above, but respectively shown in front, side, rear and top views.

The improved ironing machine of this invention consists of a machine frame including a pedestal 1 on which there is mounted a vertical column 2.

Inside the said column there is provided a support means for a shaft, which may be rotated about its axis, preferably by the action of a double-acting cylinder connected by a chain (not shown in the figure).

On the top of the said shaft there is fixedly secured the upper portion of a dummy 3 suitably shaped at the front. The dummy 3 is provided at its front-lower portion with a articulated member 4, which may assume two fixed positions so as to clamp the two front edges of a jacket or other similar article of clothing underneath the lapels thereof.

The machine includes further a platen 5, connected to a presser 6, which may travel in a direction orthogonal to the rear portion of the dummy.

With the said platen 5 there is integral a rear mould 7, shaped so as to abut against the lapels of the article to be ironed to exert thereon an adequate pressure.

A second platen 8 is placed at the upper portion vertically above the dummy 3 and is connected to a presser 9 which may travel from a high position to a low position and vice versa in a direction substantially coinciding with the axis of the dummy. To the said platen 8 there is fastened an upper mould 10 shaped so as to conform to the shape of the upper portion of the dummy 3, and serving to carry out the ironing of the rear portion and the lateral parts of the collar.

The actions of the two platens 5 and 8, referred to above, are carried out successively, and they have to compress by their ends the same portion of the collar or the lapels; this is accomplished in order not to create discontinuities in the ironing of the latter.

The moulds 7 and 10 are connected through the ducts 11 to a small tank 12 provided with valves (not shown in the figure) so as to feed steam on the parts to be ironed.

Through the aforesaid ducts 11 and the valves of the tank 12, it is possible to also exert a suction action on the shaped moulds 7 and 10, thereby promoting the drying of the steamed article.

The platens 5 and 8 are in turn connected through the ducts 13 to a suction apparatus (not shown in the figure) so as to absorb the excess steam flowing laterally out of the aforementioned moulds 7 and 10.

The said dummy 3 is also in communication with apparatuses adapted to exert a blowing action (with warm air) or suction.

The drying of the steamed and ironed article of clothing may be carried out according to the most appropriate process for the type of cloth material constituting the article of clothing.

The positioning of the latter on the dummy 3 is facilitated by the presence of a small mirror 14, enabling the operator to observe the rear portion of the article to be ironed, and two or more optical projectors 15 disposed at the upper part of the ironing machine and projecting light beams onto predetermined points of the dummy.

The improved ironing machine of this invention is also provided with a steam iron 16, placed on a side bracket 17, which enables the operator to carry out finishing operations on the article of clothing.

The operating cycle of the machine is obtained, depending on specific requirements, by a programming device 18.

During the phase in which the clothing piece is fitted over the dummy 3, the operator may by a hand or foot control 19 cause, for a period of time which may be varied at will, the lowering of the platen 8, which can exert a steaming action, thereby facilitating the adjustment of the positioning of the article of clothing.

Subsequent to the ironing operation performed in a fully automatic cycle by the upper mould 10 on the rear portion and side portions of the collar, the dummy 3 effects a rotation through 180°. Thereafter, the rear platen 5, 7 enters into operation, and effects ironing of the front portion of the collar and the lapels.

After such phase has been performed, the dummy may optionally accomplish a further rotation through 180° automatically or by operation of a supplementary control 19.

From the foregoing description and from perusal of the various figures on the accompanying drawings, one may easily see the functional character and the practical application characterizing the improved ironing machine of this invention, adapted to ensure the ironing of the collar and lapels of a jacket, overcoat or other similar article of clothing. It is of course understood that changes and modifications may be introduced therein without departing from the scope of this invention as defined by the appended claims.

I claim:

1. A machine, for the ironing of the collar and lapels of articles of clothing, comprising:

i. A machine frame ii. a dummy mounted rotatably on said machine frame for rotation about a vertical axis iii. means on said frame and connected to said dummy for rotating said dummy through 180° iv. a first presser mould mounted on said machine frame above said dummy and movable vertically between a raised position above the dummy and a lowered position in which it bears against the rear and sides of the collar of an article of clothing on the dummy, when said dummy is in a first position of rotation, v. a second presser mould mounted on said machine frame laterally of said dummy and mounted between a first position remote from the dummy and a second position in which it bears against the front of the collar and the lapels of the article of clothing, when said dummy is in a second position rotated 180° from said position of rotation.

2. A machine, as claimed in claim 1, comprising means on said dummy at a front lower portion thereof for releasably clamping the front edges of the article of clothing underneath the lapels.

3. A machine, as claimed in claim 1, comprising means on said frame for provision of steam and for application of suction, a tank communicating with said steam and suction means, and conduit means and valve means selectively providing communication between said tank and said moulds.

4. A machine, as claimed in claim 1, further comprising a mirror on the machine frame positioned to enable an operator, stationed at the front of the dummy, to be able to observe the rear portion of the dummy and an article of clothing thereon.

5. A machine, as claimed in claim 1, further comprising optical projector means on said machine frame positioned to project beams of light onto said dummy to facilitate positioning of an article of clothing thereon.

6. A machine, as claimed in claim 1, further comprising a bracket on said machine frame, and a steam iron removably supported on said bracket.

7. A machine, as claimed in claim 1, wherein said dummy is provided with passages for warm air and for suction, and further comprising means for the provision selectively of a supply of warm air and suction to said dummy.

* * * * *